US006389644B1

(12) United States Patent
Russo

(10) Patent No.: US 6,389,644 B1
(45) Date of Patent: May 21, 2002

(54) HINGE ADAPTER FOR HANGING A DOOR

(76) Inventor: John R. Russo, 113 B. Cherry Parke, Cherry Hill, NJ (US) 08002

( * ) Notice: Subject to any disclaimer, the term of this patent is extended or adjusted under 35 U.S.C. 154(b) by 0 days.

(21) Appl. No.: 09/658,952

(22) Filed: Sep. 11, 2000

(51) Int. Cl.[7] ..... E05D 5/00
(52) U.S. Cl. ..... 16/382; 16/254; 16/DIG. 43
(58) Field of Search ..... 16/382, 354, 254, 16/272, 234, 387, 223, DIG. 43; 52/213, 215, 207, 252; 160/229.1, 236, 235; 49/399, 400, 397

(56) References Cited

U.S. PATENT DOCUMENTS 2,717,666 A * 9/1955 Morales ..... 16/382
3,774,345 A * 11/1973 Cole et al. ..... 16/382
4,034,514 A * 7/1977 Cecil ..... 52/213
4,087,942 A * 5/1978 Herrmann ..... 16/382
4,281,480 A * 8/1981 Wendt ..... 52/213
4,344,256 A * 8/1982 King ..... 16/382
4,825,509 A * 5/1989 Mitchell et al. ..... 16/382
5,172,519 A * 12/1992 Cooper ..... 49/400
5,327,684 A * 7/1994 Herbst ..... 16/382

* cited by examiner

*Primary Examiner*—Chuck Y. Mah
(74) *Attorney, Agent, or Firm*—Richard P. Gilly

(57) ABSTRACT

A hinge adapter is described, providing a new construction for hanging a door in a door frame. The hinge adapter of the invention comprises two major components, the first being a hinge-to-door adapting member and the second being a hinge-to-jamb adapting member. These two adapting members each have at least two mortises for receiving a hinge plate. Preferably, these adapting members also each have a plurality of holes for use in attaching the respective adapter to either a door, or to a doorjamb. Attaching the two adapting members to the door and to the door jamb, with at least two hinges between them, allows the hanging of the door upon the doorjamb with the attachment of the door to the jamb being made over a larger area of the jamb and the door, than if the at least two hinges were attached directly to the door and the door jamb.

14 Claims, 3 Drawing Sheets

HINGE ADAPTER FOR HANGING A DOOR

FIELD OF THE INVENTION

The present invention relates to arrangements for hanging doors in door frames. In particular, the present invention relates to a hinge adapter that can be mated with a door edge and also to a door jamb, for use in hanging the door in a door frame. The new hinge adapter allows a door to be re-hung in a door frame using hinges that are provided with the hinge adapter of this invention, but where the holes used for mounting the hinges have become stripped. The new hinge adapter also provides for an increased area of the door and door frame surfaces to be used for hanging the door. Use of the new hinge adapter in hanging a door allows the door to be securely hung in the door frame without the need for making mortises in the door or the jamb of the door frame.

BACKGROUND OF THE INVENTION

A variety of methods are currently used for hanging a door. A typical method involves forming a selected number of mortises in a door jamb, where the number of mortises is equal to the number of hinges to be used for the door. The door to be used is also mortised along a side of the door, for receiving hinges. The door is hung by placing the door in the door frame and then inserting hinge pins into the hinges. The door being hung frequently requires hand fitting to a door frame, which requires a substantial amount of skill and time.

The door hanging systems known have limitations in their use, however, because they may be expensive or difficult to manufacture, or their design is not easily adapted to supporting a wide variety of articles to be supported. There remains a need in the art for a door hanging system that can be manufactured economically, used easily by either a consumer or by a professional to hang a door in a door frame and which also has a design that allows an old door to be easily re-hung in a door frame. The hinge adapter of the present invention as described herein meets these needs.

To overcome the shortcomings of known door hanging systems, I have now designed a new door hanging system, and a new hinge adapter for mounting hinges on a door jamb. The new hinge adapter includes a new construction for hanging a door in a door frame.

SUMMARY OF THE INVENTION

Briefly, a door hanging system is disclosed here that can be readily used to mount a door in a door frame where the door had been previously mounted, but where the holes used to attach the door hinges to the door frame had become stripped. The new hinge adapter can also be used to hang a new door in a door frame, without the need for making mortises in the door or door jamb for accommodating the hinges used with the door. Other embodiments may readily be adapted for mounting other types of doors.

The door hanging system of the present invention uses a new hinge adapter. The hinge adapter provides a new construction for hanging a door in a door frame. The hinge adapter of the invention comprises two major components, the first being a hinge-to-door adapting member and the second being a hinge-to-jamb adapting member. These two adapting members each have at least two mortises for receiving a hinge plate. Preferably, these adapting members also each have a plurality of holes for use in attaching the respective adapter to either a door, or to a door janb. Attaching the two adapting members to the door and to the door jamb, with at least two hinges between them, allows the hanging of the door upon the door jamb with the attachment of the door to the jamb being made over a larger area of the jamb and the door, than if the at least two hinges were attached directly to the door and the door jamb.

The hinge adapter disclosed here can be used to overcome a common problem with doors where the mounting holes used to attach the hinges from a door to the door frame becomes stripped over time. Use of the inventive hinge adapter allows the door to be hung again in the same door frame. The hinge adapter preferably includes a set of hinges adapted for use with the door adapter. Such hinges can be equal in number to those originally used with the particular door and door frames, or different in number.

The new hinge adapter may be viewed as a tvpe of extension for the plates of the hinges. By attaching the hinges to the new hinge adapter of the present invention, and then attaching the hinge adapter to the door and the door jamb of the door frame a larger effective area for attachment is presented by the hinges. The new hinge adapter then may be viewed as a large extension of the plates of the hinges. The hinges may be securely attached to mortises within the hinge adapter. This attachment can be advantageously made using sheet metal screws bolt-and-nut fasteners. Wood screws can be used to securely attach the new hinge adapter to the door and door jamb, if the door and door frame are of wood construction.

The hinge adapter disclosed here thereby provides an extended area on both the door and the door jamb for attachment of the door to the door jamb. Fasteners such as screws can be used in these extended areas for hanging the door to the door jamb.

It is accordingly an aspect of the invention to provide a door hanging system that is well suited for reusing a door in a doorframe, where the holes in the doorframe for mounting the hinges have become stripped.

It is also an aspect of the invention to provide a door hanging system that is well suited for reusing a the hinges previously used for a particular door in a doorframe, where the holes in the doorframe for mounting the hinges, or the holes in the door for mounting the hinges have become stripped.

It is another aspect of the invention to provide a door hanging system that can be manufactured easily from extruded metal.

It is another aspect of the invention to provide a door hanging system that is made in kit form, to reduce the cost of manufacturing.

It is a further aspect of the invention to provide a door hanging system that can use commercially available door hinges for hanging a door, while also allowing convenient hanging in a door frame where the holes in the door frame for mounting the hinges have become stripped.

It is another aspect of the invention to provide a new door hanging construction that can use commercially available door hinges for hanging a door, while also providing greater strength of the attachment of the door to a door frame.

It is yet another aspect of the invention to provide a new door hanging system that can be easily installed by a homeowner using common tools that are available to an ordinary homeowner.

It is yet another aspect of the invention to provide a new door hanging system that can be easily installed by a homeowner, with little skill needed by the homeowner.

It is yet another aspect of the invention to provide a new door hanging system that can be used when the holes in the door frame for mounting the hinges become stripped.

It is yet another aspect of the invention to provide a new door hanging system that can be easily installed by a homeowner, where the hanging system allows for easy adjustment by shimming of the door mounting in a doorframe.

It is still another aspect of the present invention to provide a new door hanging system that is stronger and more resistant to break-in than conventional hinge-on-jamb arrangements.

It is still another aspect of the present invention to provide a hinge adapter that allows commercially available door hinges to be used for hanging a door, while also reinforcing the doorjamb.

These aspects, and others set forth more fully below are achieved by the present invention.

DETAILED DESCRIPTION OF THE INVENTION

Figure 1:
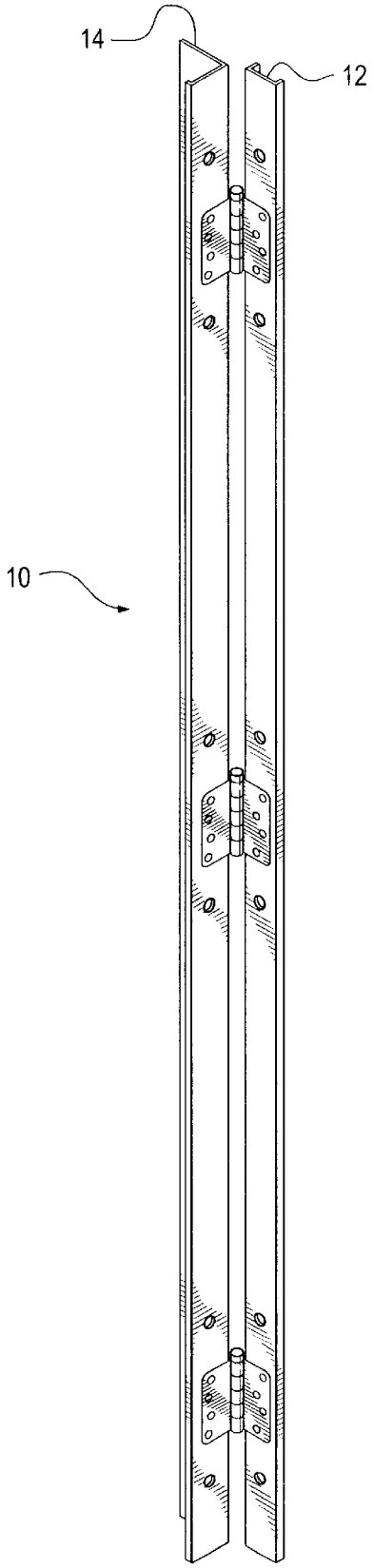
FIG. 1 is an illustration of a perspective view of a preferred embodiment of a hinge adapter according to the invention.

A hinge adapter is disclosed here, for use in hanging a door in a door frame, the new hinge adapter comprising: a hinge-to-door adapting member and a hinge-to-jamb adapting member.

The hinge-to-door adapting member comprises a first elongated plate, generally rectangular, dimensioned with a length substantially equal to the height of the door, and having first and second opposed major faces, first and second opposed long edges and first and second opposed short edges. This member also has in its first major face at least two spaced apart mortises. Each of these mortises is dimensioned to receive a plate of a hinge. The hinges that are suitable for use with the present invention include conventional door hinges, that have two hinge plates that are joined by a pivoting portion.

The hinge-to-jamb adapting member comprises a second elongated plate, generally rectangular, dimensioned with a length substantially equal to the height of the door frame, and having first and second opposed major faces, first and second opposed long edges and first and second opposed short edges. This adapting member has in its first major face at least two spaced apart mortises, the at least two spaced apart mortises are each dimensioned to receive a plate of a hinge.

Preferably, the new hinge adapter disclosed here includes a plurality of holes disposed along its length. That is, it is preferred that both the hinge-to-door adapting member and the hinge-to-jamb adapting member, have holes for admitting through the adapting members screws. Screws can be used for attaching these members to either a door or a door jamb, respectively. Screws can also be used to attach a plate of a hinge to each mortise in these members.

The at least two spaced apart mortises of the hinge-to-jamb adapting member are equal in number to the at least two spaced apart mortises of the hinge-to-door adapting member, and wherein the mortises are aligned within the hinge-to-door and hinge-to-jamb adapting members for use in combination for hanging the door.

In a preferred embodiment of the new hinge adapter, space is allowed in the hinge-to-door adapting member for accommodating shims. One or more shims of selected dimensions may be added by a user to a channel in the hinge-to-door adapting member for adjusting the positioning of the hinge-to-door adapting member on a mounting edge of a door, for purposes of making the door hang plumb in a door frame. The hinge-to-door adapting member is preferably mortised for receiving the at least two hinges. It is preferred that the mortises be dimensioned with sufficient depth to allow the hinges to be mounted flush in the hinge-to-door adapting member. Optionally, a third or even a fourth hinge may be used. Preferably, two or three hinges are used; and most preferably, three hinges are used.

The new door hanging system can be manufactured using a rigid extruded material. Preferably, an extruded metal such as aluminum or steel is used. More preferably, surface treated steel such as a galvanneal™ steel is used for these members.

The new hinge adapter and door hanging system disclosed here will be readily understood by those skilled in the art, by considering the following example. The example illustrates an exemplary embodiment of the new system. This embodiment is depicted in the accompanying drawings. With reference to these drawings, wherein like reference numerals designate similar parts throughout the various views, this embodiment will be considered now.

FIG. 1 shows a first embodiment 10 of a hinge adapter according to the present invention. The hinge adapter shown includes a hinge-to-door adapting member 12, and a hinge-to-jamb adapting member 14. These two members are shown with three conventional door hinges mounted intermediate the adapting members.

Figure 2:
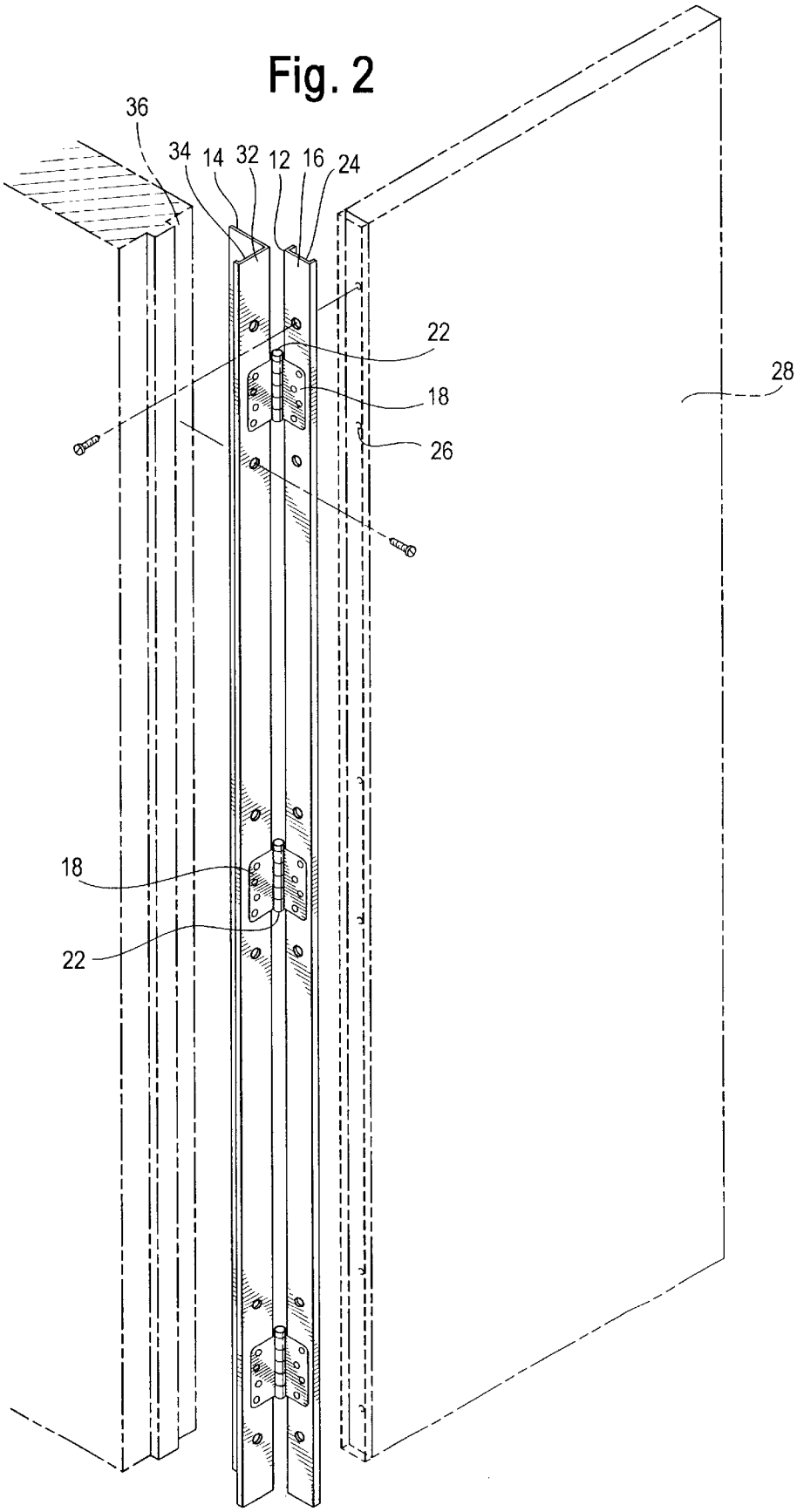
FIG. 2 is an illustration of a perspective view of the embodiment of FIG. 1, showing how the hinge adapter may be mounted intermediate a door and a door jamb.

In FIG. 2 may be seen an illustration of the hinge adapter embodiment of FIG. 1, with a door and a door jamb depicted in broken lines. The relationship of the hinge adapter to the door and the door jamb can be seen as follows. The hinge-to-door adapting member 12 has a first major face 16 that is mortised to receive the plates 18 of hinges 22. A second major face 24 of the hinge-to-door adapting member, opposed to the first major face 16, is for attachment to an edge 26 of the door 28.

Also in FIG. 2 may be seen the orientation of the hinge-to-jamb adapting member 14. This member 14 has a first major face 32 that is mortised to receive plates 18 of hinges 22. An opposed second major face 34 is for attachment to the door jamb 36.

Figure 3A:
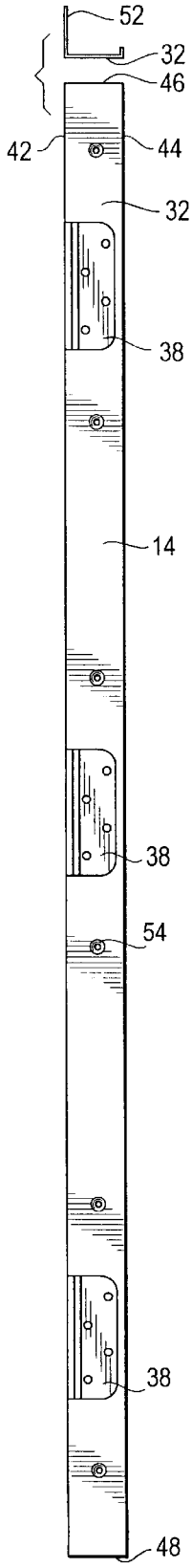
FIG. 3A is an illustration of a plan view of the hinge-to-jamb adapting member of the embodiment of FIG. 1.
Figure 3B:
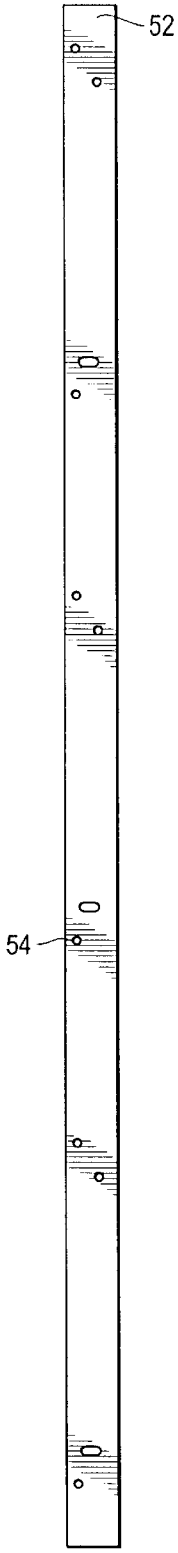
FIG. 3B illustrates a side view of the hinge-to-jamb adapting member of FIG. 3A.

In FIG. 3A may be seen the hinge-to-jamb adapting member 14 with the its first major face 32 facing the viewer. Three mortises 38 are visible in the first major face 32. These mortises are each sized and shaped to receive a hinge plate 18 of a conventional door hinge 22. The hinge-to-jamb adapting member 14 has a first long edge 42, a second long edge 44, a first short edge 46, and a second short edge 48. In this preferred embodiment, the hinge-to-jamb adapting member 14 further comprises a wall 52 extending orthogonally from the member's first long edge 42, thereby giving the hinge-to-jamb adapting member an L shaped profile. The wall 52 is depicted in the side elevation view, FIG. 3B. Preferably, a hinge adapter according to the present invention comprises a wall 52. This wall covers a face of the door jamb, upon which the hinge adapter is attached. The covering of this jamb face can serve an esthetic purpose—serving as a trim covering for the door jamb. The covering of this jamb face can also serve a functional purpose—serving to strengthen the mounting of the door in the door frame by providing a greater area of attachment of the door to the door frame, and allowing a greater area for mounting fasteners such as screws to be used to attach the door to the door frame. This wall can extend for a distance of up to about 9 cm, with the distance selected by a user to suit a particular door jamb. The hinge-to-jamb adapting member 14 shown in FIG. 3A has a plurality of holes 54 for admitting therethrough mounting fasteners such as screws. Optionally, the extending wall 52 can also comprise holes 54 for such mounting fasteners.

Figure 4:
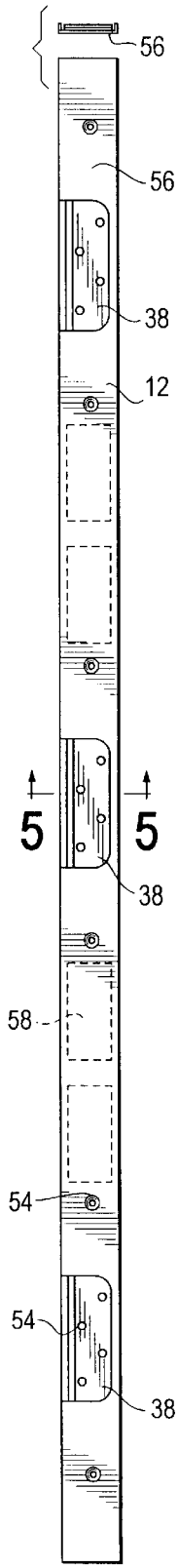
FIG. 4 As an illustration of a plan view of the hinge-to-door adapting member of FIG. 1.

FIG. 4 illustrates a hinge-to-door adapting member 12 in accordance with this preferred embodiment of the new hinge adapter. The first major face 56 of the adapting member is shown facing the viewer. Three mortises 38 are shown in this first major face, the mortises being sized and shaped to receive a hinge plate of a conventional door hinge. This hinge-to-door adapting member preferably has a plurality of holes 54, sized to receive mounting fasteners such as screws, for attaching the hinge-to-door adapting member to a door.

The mortises for receiving a hinge plate, are shown as having holes 54 through the respective members. These holes are preferred in an embodiment of the present invention, as providing convenience for attaching hinges to the hinge adapter.

Figure 5:
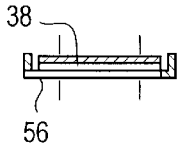
FIG. 5 cepicts a section view of the hinge-to-door adapting member of FIG. 4.

FIG. 5 shows a sectional view of the hinge-to-door adapting member of FIG. 4, at a mortise 38.

Figure 6:
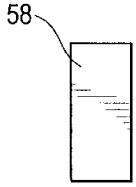
FIG. 6 an illustration of a plan view of a reinforcing plate of the hinge-to-door adapting member of FIG. 4.

A reinforcing plate 58, that is preferably used as a part of the hinge-to-door adapting member of the present invention, is shown in FIG. 6. This plate provides stiffening of the hinge-to-door adapting member, and also provides a surface upon which one or more shims can be used in the attachment of the hinge-to-door adapting member to the door. This reinforcing plate may be fixed to the hinge-to-door adapting member by a method known in the art such as spot welding.

The optional use of shims (not shown) to aid in attaching the door plumb in the door frame will be appreciated by users of the new hinge adapter. These shims can be concealed from view beneath the hinge-to-door adapting member, if the hinge-to-door adapting member has the extending walls 62, 64 of the preferred embodiment.

It is preferred that the hinge-to-door adapting member further comprises: a first wall 62 extending orthogonally from the first long edge 66 of this member, and a second wall 64 extending orthogonally from the second long edge 68; and that the first wall and second wall extend from the second major face 24 of the hinge-to-door adapting member. The first wall 62 and second wall 64 serve as trim for the hinge-to-door adapting member, concealing any space that may be behind the thickness of the member, for accommodating the hinge mortises. The first wall and second wall give the hinge-to-door adapting member a U shaped profile. The first wall and second wall can each extend for a distance of up to about 5 cm, with the distance selected by a user to suit a particular door and the user's preference.

The new hinge adapter may be used for hanging either a new door or a existing door. For hanging an existing door, a strip of material may be removed from the edge 26 of the door. Such a strip is depicted in broken lines in FIG. 2. The removal of this strip allows space for the thickness of the hinge-to-door adapting member to be mounted on the door, with the door still fitting into the existing door frame. For re-hanging an existing door in its frame, a strip of material of from about 0.3 to about 2.0 cm can be removed from the door. Preferably, a strip of about 1 to about 1.5 cm can be removed.

The present invention is not to be limited in scope by the embodiment disclosed herein, which is intended as a single illustration of one aspect of the invention, and any which are functionally equivalent are within the scope of the invention. Indeed, various modifications of the invention, in addition to that shown and described herein, will become apparent to those skilled in the art from the foregoing description. Such modifications are intended to fall within the scope of the appended claims.

I claim:

1. A hinge adapter for use in hanging a door in a door frame, comprising:

a) a hinge-to-door adapting member, comprising: a first elongated plate, generally rectangular, dimensioned with a length substantially equal to the height of the door, and having first and second opposed major faces, first and second opposed long edges and first and second opposed short edges, having in the first major face at least two spaced apart mortises, the at least two spaced apart mortises each dimensioned to receive a plate of a hinge;

wherein the first elongated plate has a plurality of holes disposed along the plate's length, each hole for receiving a mounting screw for attaching the hinge-to-door adapting member to a door; and b) a hinge-to-jamb adapting member, comprising: a second elongated plate, generally rectangular, dimensioned with a length substantially equal to the height of the door frame, and having first and second opposed major faces, first and second opposed long edges and first and second opposed short edges, having in the first major face at least two spaced apart mortises, the at least two spaced apart mortises each dimensioned to receive a plate of a hinge;

wherein the second elongated plate has a plurality of holes disposed along the plate's length, each hole for receiving a mounting screw for attaching the hinge-to-jamb adapting member to a door frame; wherein the at least two spaced apart mortises of the hinge-to-jamb adapting member are equal in number to the at least two spaced apart mortises of the hinge-to-door adapting member, and wherein the mortises are aligned within the hinge-to-door and hinge-to-jamb adapting members for use in combination for hanging the door.

2. The hinge adapter according to claim 1, wherein the plurality of holes is distributed along the hinge-to-door adapting member and along the hinge-to-jamb adapting member for attaching the hinge adapter between the door and the door frame.

3. The hinge adapter according to claim 1, wherein the hinge-to-door adapting member further comprises: a first wall extending orthogonally from the first long edge, and a second wall extending orthogonally from the second long edge; and wherein the first wall and second wall extend from the second major face of the hinge-to-door adapting member.

4. The hinge adapter according to claim 1, wherein the hinge-to-jamb adapting member further comprises: a wall extending orthogonally from the first long edge, and extending from the second major face of the hinge-to-jamb adapting member.

5. The hinge adapter according to claim 1, wherein the hinge-to-door adapting member further comprises: a first wall extending orthogonally from the first long edge, and a second wall extending orthogonally from the second long edge; and wherein the first wall and second wall extend from the second major face of the hinge-to-door adapting member; and-wherein the hinge-to-jamb adapting member further comprises: a wall extending orthogonally from the first long edge, and extending from the second major face of the hinge-to-jamb adapting member.

6. The hinge adapter according to claim 5, wherein the plurality of holes is distributed along the hinge-to-door adapting member and along the hinge-to-jamb adapting member for attaching the hinge adapter between the door and the door frame.

7. A door hanging system in kit form, for assembly by a user, comprising:

a) a hinge-to-door adapting member, comprising: a first elongated plate, generally rectangular, dimensioned with a length substantially equal to the height of the door, and having first and second opposed major faces, first and second opposed long edges and first and second opposed short edges, having in the first major face at least two spaced apart mortises, the at least two spaced apart mortises each dimensioned to receive a plate of a hinge;

wherein the first elongated plate has a plurality of holes disposed along the plate's length, each hole for receiving a mounting screw for attaching the hinge-to-door adapting member to a door; and b) a hinge-to-jamb adapting member, comprising: a second elongated plate, generally rectangular, dimensioned with a length substantially equal to the height of the door frame, and having first and second opposed major faces, first and second opposed long edges and first and second opposed short edges, having in the first major face at least two spaced apart mortises, the at least two spaced apart mortises each dimensioned to receive a plate of a hinge;

wherein the second elongated plate has a plurality of holes disposed along the plate's length, each hole for receiving a mounting screw for attaching the hinge-to-jamb adapting member to a door frame; wherein the at least two spaced apart mortises of the hinge-to-jamb adapting member are equal in number to the at least two spaced apart mortises of the hinge-to-door adapting member, and wherein the mortises are aligned within the hinge-to-door and hinge-to-jamb adapting members for use in combination for hanging the door.

8. The door hanging system according to claim 7, wherein the plurality of holes is distributed along the hinge-to-door adapting member and along the hinge-to-jamb adapting member for attaching the door hanging system between the door and the door frame.

9. The door hanging system according to claim 7, wherein the hinge-to-door adapting member further comprises: a first wall extending orthogonally from the first long edge, and a second wall extending orthogonally from the second long edge; and wherein the first wall and second wall extend from the second major face of the hinge-to-door adapting member.

10. The door hanging system according to claim 7, wherein the hinge-to-jamb adapting member further comprises: a wall extending orthogonally from the first long edge, and extending from the second major face of the hinge-to-jamb adapting member.

11. The door hanging system according to claim 7, wherein the hinge-to-door adapting member further comprises: a first wall extending orthogonally from the first long edge, and a second wall extending orthogonally from the second long edge; and wherein the first wall and second wall extend from the second major face of the hinge-to-door adapting member; and wherein the hinge-to-jamb adapting member further comprises: a wall extending orthogonally from the first long edge, and extending from the second major face of the hinge-to-jamb adapting member.

12. The door hanging system according to claim 11, wherein the plurality of holes is dstributed along the hinge-to-door adapting member and along the hinge-to-jamb adapting member for attaching the door hanging system between the door and the door frame.

13. A method of hanging a door in a frame, comprising:

a) providing a hinge adapter, the hinge adapter comprising a hinge-to-door adapting member and a hinge-to-jamb adapting member;

the hinge-to-door adapting member, comprising: a first elongated plate, generally rectangular, dimensioned with a length substantially equal to the height of the door, and having first and second opposed major faces, first and second opposed long edges and first and second opposed short edges, having in the first major face at least two spaced apart mortises, the at least two spaced apart mortises each dimensioned to receive a plate of a hinge;

wherein the first elongated plate has a plurality of holes disposed along the plate's length, each hole for receiving a mounting screw for attaching the hinge-to-door adapting member to a door; and the hinge-to-jamb adapting member, comprising: a second elongated plate, generally rectangular, dimensioned with a length substantially equal to the height of the door frame, and having first and second opposed major faces, first and second opposed long edges and first and second opposed short edges, having in the first major face at least two spaced apart mortises, the at least two spaced apart mortises each dimensioned to receive a plate of a hinge;

wherein the second elongated plate has a plurality of holes disposed along the plate's length, each hole for receiving a mounting screw for attaching the hinge-to-jamb adapting member to a door frame; wherein the at least two spaced apart mortises of the hinge-to-jamb adapting member are equal in number to the at least two spaced apart mortises of the hinge-to-door adapting member, and wherein the mortises are aligned within the hinge-to-door and hinge-to-jamb adapting members for use in combination for hanging the door;

b) attaching the hinge-to-door adapting member to an edge of a door;

c) attaching the hinge-to-jamb adapting member to a door jamb; and d) attaching at least two hinges to the at least two spaced apart mortises of the hinge adapter, intermediate the hinge-to-door adapting member and the hinge-to-jamb adapting member.

14. The method according to claim 13, further comprising:

e) removing a strip of material from the edge of the door before step b).

* * * * *